United States Patent [19]

Simm

[11] 4,153,836

[45] May 8, 1979

[54] METHOD OF ALTERING THE GRADATION IN ELECTROSTATIC RECORDING OF HALF-TONE IMAGES

[75] Inventor: Walter Simm, Leverkusen, Fed. Rep. of Germany

[73] Assignee: AGFA-Gevaert A.G., Leverkusen, Fed. Rep. of Germany

[21] Appl. No.: 839,778

[22] Filed: Oct. 6, 1977

[30] Foreign Application Priority Data

Oct. 12, 1976 [DE] Fed. Rep. of Germany ..... 2645928

[51] Int. Cl.[2] ..... H01T 19/04

[52] U.S. Cl. ..... 250/325

[58] Field of Search ..... 250/325

[56] References Cited

U.S. PATENT DOCUMENTS

| | | | |
|---|---|---|---|
| 2,756,676 | 7/1956 | Steinhilper | 250/325 |
| 2,965,756 | 12/1960 | Vyverberg | 250/325 |
| 3,084,061 | 4/1963 | Hall | 250/325 |
| 4,060,382 | 11/1977 | Vertegaal | 250/325 |

*Primary Examiner*—Harold A. Dixon

[57] ABSTRACT

The recording of half-tone images by electrophotographic and electrographic recording processes can easily be controlled by a method of altering the gradation in electrostatographic recording of latent charge images of half-tone originals wherein a first latent charge image produced on a primary recording material is recorded as a second latent charge image of altered gradation on a secondary recording carrier by means of a charging current which is controlled by a slotted diaphragm.

5 Claims, 4 Drawing Figures

METHOD OF ALTERING THE GRADATION IN ELECTROSTATIC RECORDING OF HALF-TONE IMAGES

This invention relates to a method by which the shape of the density curve of an electrostatic charge image can be advantageously altered for the reproduction of half-tone images.

It is well-known that electrostatic charge images can be recorded either photographically on photoconductive recording materials or by a non-photographic process using an opto-electronic device which records on an electrically insulating image carrier. The first type of process is generally referred to as electrophotographic and the second as electrostatic, but both types of process are frequently referred to as electrostatographic. It is in this sense that the term "electrostatographic" is used in this specification.

The recording of half-tone images by electrophotographic or electrographic processes requires a completely different shape of density curve from that suitable for recording line images. The reproduction of line images generally requires a steep gradation to produce a hard-edged transition from white to black without intermediate shades. For half-tone copies, the process must fulfil more difficult conditions. It must be able to reproduce numerous grey values (half-tones) and must contain within itself the possibility of correcting the shape of the density curve. This possibility of correction is particularly important in colour reproduction processes because even slight deviations from the nominal density of individual separation colours produce a colour tinge in the final image.

When electrophotographic recording processes are employed, measures for altering the shape of the density curve are also necessary because the special properties of the photoconductive material in most cases cause the shape of the charge density/exposure curve of the latent charge image to deviate substantially from the desired characteristic.

It is known that by connecting electronic devices into the system it is possible to scan original images pointwise by opto-electronic means and to produce electrical image signals which can be corrected in the desired manner. These corrections can be applied to the reproduction of images by electrophotographic or electrographic recording processes. However, these electronic devices are very complex and expensive.

It is an object of the present invention to provide means whereby the recording of half-tone images in black and white and in colour by electrophotographic or electrographic recording processes can easily be controlled as desired without a complicated electronic device.

According to the invention there is provided a method of altering the gradation is electrostatographic recording of latent charge images of half-tone originals, wherein a first latent charge image produced on a primary recording carrier is recorded as a second latent charge image of altered gradation on a secondary recording carrier by means of a charging current which is controlled by a slotted diaphragm.

The distribution of charge density of electrostatic charge images can be altered as desired within a wide range by using the transfer process according to the invention. The transfer process can be adjusted so that certain ranges of density of the recorded image are transferred in attenuated form. For example, the densities in the lower range may be transferred in only a fraction of their theoretically possible value. The density curve of the transferred charge image (referred to as second charge image) is therefore flatter in the lower part and steeper in the upper part than that of the original image (referred to as first charge image).

To carry out the transfer of charge the carrier of the first charge image is covered by the secondary recording carrier on which the second charge image is to be produced, for example an electrically insulating film, and that side of the secondary recording carrier which is not in contact with the carrier of the first charge image is charged by a charging current through the aperture of a slotted diaphragm. The charging current is produced by a Corona discharge, preferably in concentrated nitrogen, from a discharge electrode. When the secondary recording carrier has been charged, it is removed from the carrier of the first charge image and transferred to an electrostatographic development apparatus known per se, in which a visible image is produced from the second charge image.

The first charge image can be produced in known manner by known electrostatographic processes. Detailed descriptions of suitable electrostatographic recording processes and materials may be found in the writings by J. H. Dessauer and H. E. Clark in "Xerography and related Processes," The Focal Press London and New York (1965) and R. M. Schaffert in "Electrophotography." The Focal Press London and New York (1965). Examples of suitable electostatographic recording processes include processes operation with photoconductive recording elements, in which charge images are produced by direct imagewise exposure or by exposure to laser beams or by means of so-called pin tubes. Purely electrostatic recording processes in which charge images are recorded on an electrically insulating recording carrier, for example by means of pin tubes, electron beams and Lenard windows or relief electrodes are also suitable.

Development of the charge images produced by the process of the invention may also be carried out by methods already known for this purpose but it is preferred to use those processes which are suitable for reproducing low densities and at the same time ensure a high resolution. These include, for example, electrophoretic developmentprocesses and aerosol processes. Detailed descriptions of processes suitable for the development of charge images may be found in the above memtioned works by Dessauer and Schaffert.

The principle of the process according to the invention, by means of which the transfer characteristic can be adjusted and controlled will now be described with reference to FIGS. 1 to 4 of the accompanying drawings, in which.

Figure 1:
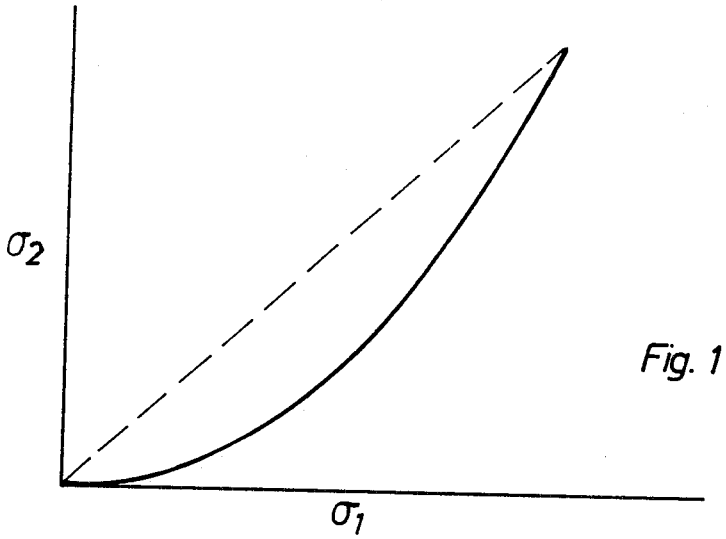
FIG. 1 shows two possible shapes of transfer curves.

In the graph of FIG. 1, the charge density $\sigma 1$ of a first charge image is plotted along the abscissa and the charge density $\sigma 2$ of the transferred, second charge image is plotted along the ordinate. If all density values are completely transferred, the dependence of $\sigma 2$ on $\sigma 1$ can be represented by a straight line (broken line) passing through the zero points of the coordinates. The gradient of the line is determined at each point by the ratio of the transferred charge to the original charge.

In the course of production of the first charge image, for example by imagewise exposure of an electrically-charged photoconductive layer or by other stages of the recording process, changes are liable to occur in the ratio of the gradation of the recorded first image to the gradation of the original. For this reason, it is preferably to use a transfer function for the charge density of the recorded latent image other than the linear function represented by the straight line in FIG. 1. For example, it may be necessary to correct certain faults in the recording process by using a transfer function such as that indicated by the solid line curve in FIG. 1.

Figure 2:
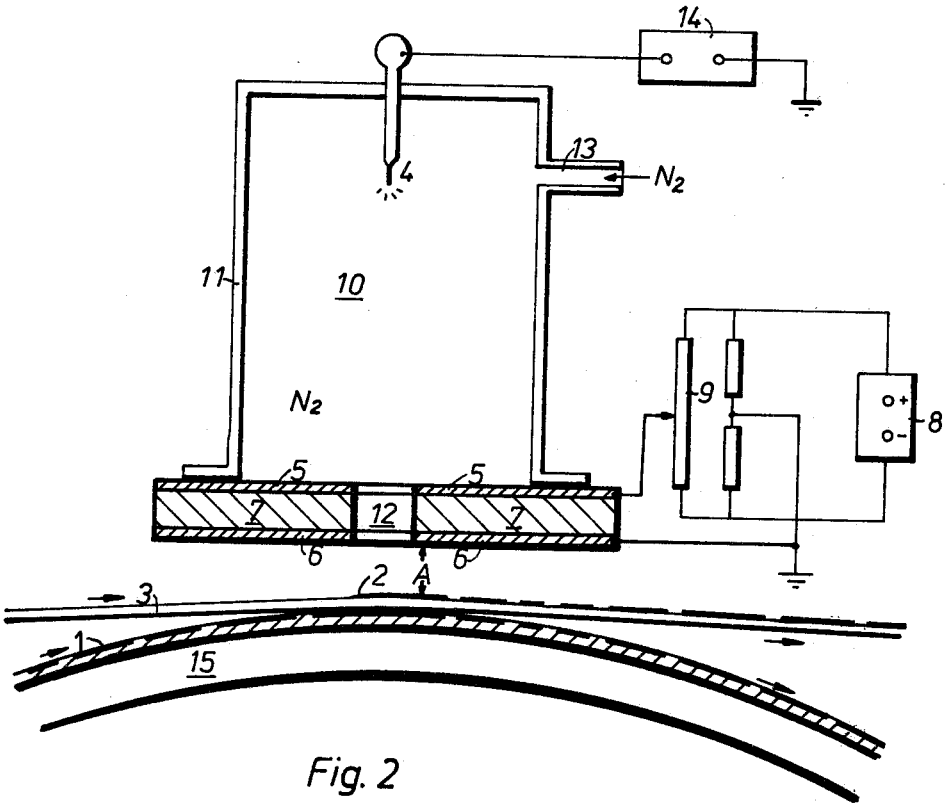
FIG. 2 is an overall plan of an apparatus for carrying out the method according to the invention.

FIG. 2 represents only the basic plan of an apparatus in which the transfer characteristic can be altered and controlled as desired by transferring a latent charge image from a primary to a secondary recording carrier.

A primary recording carrier 1 which carries the first charge image makes brief contact with a secondary recording carrier 3 in the form of an electrically insulating film which carries the second charge image. Contact is made at a region of contact 2, and at the same time that side of the secondary recording carrier 3 which is remote from the contact region 2 is charged by a charging current passing through a gap 12 in a slotted diaphragm. The current used for charging is a Corona discharge current produced at a discharge electrode 4 which is connected to a source of voltage 14. The diaphragm is a multi-layered slotted diaphragm which comprises two electrically-conductive surface layers 5 and 6 mounted on an insulating intermediate layer 7. In the process according to the invention the secondary recording carrier is charged at the contact point by current passing through the gap 12 of the slotted diaphragm. The electrically conductive surface layers 5 and 6 are connected to a source of direct voltage 8 the sign and magnitude of which can be adjusted by a potentiometer in a bridge circuit 9. A discharge chamber 10 defined by a wall 11 of the container is filled with concentrated nitrogen at atmospheric pressure. The quantity of gas escaping through the gap 12 is constantly replaced by a supply of fresh nitrogen entering at an inlet 13. The transfer characteristic is preferably altered by the voltage at the slotted diaphragm.

However, the shape of the transfer curves is also influenced by other parameters of the apparatus, such as the width of the gap in the slotted diaphragm, the thickness of the diaphragm, the distance between the diaphragm and the secondary recording carrier and the intensity of the Corona discharge current. When the apparatus is in operation, these factors can only be altered with difficulty or only within very narrow limits. On practical grounds, therefore, they are less suitable for controlling the transfer process. One factor which is theoretically very effective in controlling the transfer process but also limited in practical use for the reasons just mentioned is the distance A of the slotted diaphragm from the secondary recording carrier 3 at the contact region 2.

EXAMPLE

The primary recording carrier 1 of the first charge image is formed by a selenium layer bonded to a surface 15 of a metal drum. In operation, the drum rotates and the primary recording carrier 1 carrying the first charge image and the secondary recording carrier 3 move simultaneously in the direction indicated by the arrows in FIG. 2 and contact each other at the contact region 2.

This movement should be fast enough to prevent the charge current passing through the gap 12 completing the charging process of the secondary carrier 3 to the point of saturation.

According to the invention, the charging time is adjusted to be so short that in general only the initial current density comes into operation for charging the carrier for transfer. It is only within this range that the transfer characteristic can be influenced in the desired manner.

The charging time is the time for which the secondary recording carrier 3 is within the charging region, that is to say at the contact region 2 under the gap 12. It is therefore determined by the velocity of movement of the carrier 3 and the width of the gap.

In the transfer apparatus, a latent charge image is transferred from a selenium layer 60 μm in thickness having charge densities $\sigma s$ to a ployester film 25 μm in thickness to produce densities $\sigma_F$. The thickness of the slotted diaphragm is 150 μm and the width of the gap is also 150 μm. The polyester film is in the form of a tape moving at a rate of 40 cm per second over the rotating metal drum which is covered on its surface by the selenium layer. The foil makes contact with the selenium layer of the drum without slippage at the contact region 2.

Figure 3:
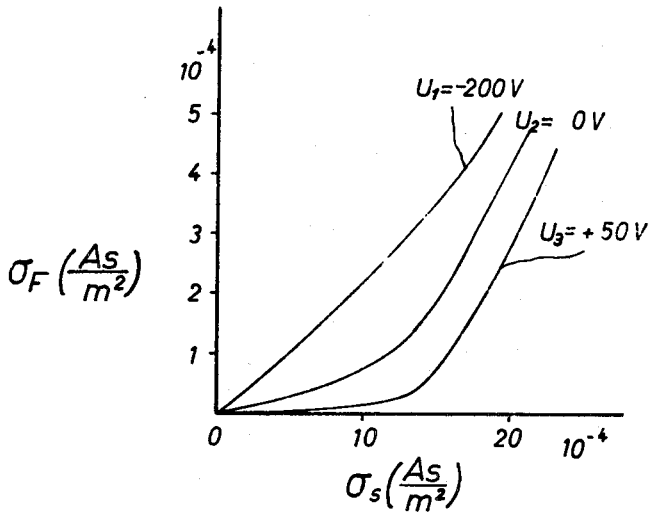
FIG. 3 and 4 are examples illustrating the adjustable shape of the transfer curves.

If various voltages U, are applied between the electrically-conductive layers 5 and 6 of the slotted diaphragm so that the internal surface (facing the discharge electrode 4) is sometimes positive and sometimes negative, a modified transfer characteristic is obtained, as represented in FIG. 3. The distance between the diaphragm and the foil is 0.4 mm. The curves shown in FIG. 3 can be seen to sag, and this sagging becomes more pronounced as the voltage changes from negative to positive. Low densities are therefore transferred attenuated and high densities are more strongly in transfer.

Figure 4:
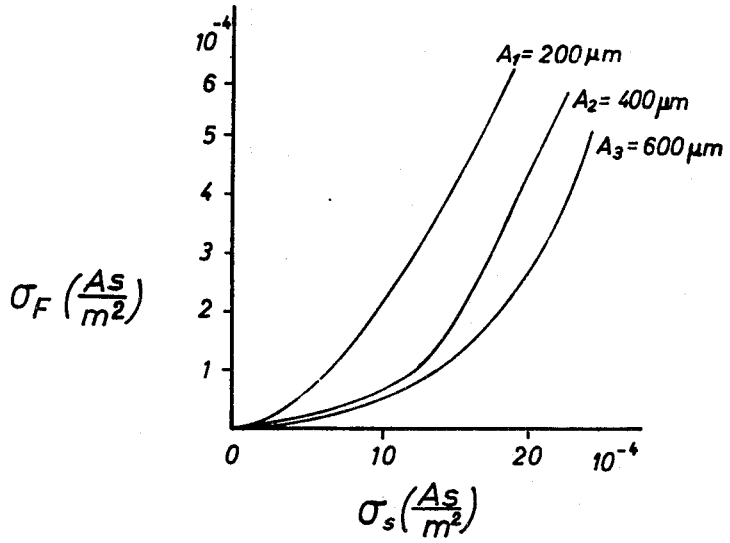

If, on the other hand, the voltage on the surface layers of the slotted diaphragm is kept a constant value or at 0 while the distance between the diaphragm and the foil is changed in a definite manner, the resulting distortion of the curves, which is represented in FIG. 4, is similar to that obtained by varrying the voltage of the diaphragm.

The curves shown in FIG. 4 are obtained by earthing the surface layers of the diaphragm and varying the distances from $A_1$ to $A_3$.

Apart from the voltages and distances given in this example, many other factors, may, of course, be adjusted to obtain suitably altered curves.

The density curve of an image copied in an electrostatographic recording device can be sufficiently corrected for practical purposes by the methods of control described above.

I claim:

1. A method of altering the gradation in the electrostatographic recording of latent charge images of halftone originals, comprising the steps of producing a first latent charge image employing a charging current to record said first image on a primary recording carrier, directing a sheet material between the primary recording carrier and a charging current means for charging the surface of the sheet material facing the charging means, placing the primary recording carrier in contact with the surface of the secondary recording carrier opposite to the charge receiving surface, employing said charging current to record by a charge transfer process said first image as a second latent charge image of altered gradation on said sheet material as a secondary recording carrier, controlling said charging current by electrical potential at a slot-like aperture formed in a diaphragm comprised of electrically conductive layers separated by insulating material.

2. In a method as claimed in claim 1 altering a transfer characteristic of the charge image by altering the electric voltage between the electrically-conductive layers of the slotted diaphragm.

3. In a method as claimed in claim 1 altering a transfer characteristic by altering the distance between the slotted diaphragm and the secondary recording carrier.

4. In a method as claimed in claim 1, supplying a nitrogen-containing gas in a flow into the area between the slotted diaphragm and the secondary recording carrier during the charging step so that production of the charging current and charging of the secondary recording carrier are carried out in said gas.

5. In a method as claimed in claim 1 adjusting the charging period so that sunstantially only the initial current density of the charging current comes into operation for charging in the locality of the contact region.

* * * * *